US010655351B1

(12) United States Patent
Sirco et al.

(10) Patent No.: US 10,655,351 B1
(45) **Date of Patent: *May 19, 2020**

(54) POOL STAIR ASSEMBLIES AND METHODS OF INSTALLING A POOL STAIR ASSEMBLY

(71) Applicant: Trojan Leisure Products, LLC, Albany, NY (US)

(72) Inventors: Collin J. Sirco, Ballston Lake, NY (US); David A. Steele, Gansevoort, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/561,797

(22) Filed: Sep. 5, 2019

Related U.S. Application Data

(60) Continuation of application No. 16/285,488, filed on Feb. 26, 2019, now Pat. No. 10,407,929, which is a division of application No. 14/844,753, filed on Sep. 3, 2015, now Pat. No. 10,240,359.

(60) Provisional application No. 62/048,618, filed on Sep. 10, 2014.

(51) Int. Cl.
*E04H 4/14* (2006.01)
*E04F 11/00* (2006.01)

(52) U.S. Cl.
CPC ..... *E04H 4/144* (2013.01); *E04F 11/00* (2013.01)

(58) Field of Classification Search
CPC ..... E04H 4/144; E04F 11/00
See application file for complete search history.

(56) References Cited

U.S. PATENT DOCUMENTS 3,236,012 A 2/1966 Laven
3,478,370 A 11/1969 Stern et al.
3,488,782 A 1/1970 Billig et al.
3,610,564 A * 10/1971 Mattingly ..... E04G 9/05 249/68
3,693,194 A 9/1972 Schindler et al.
(Continued)

FOREIGN PATENT DOCUMENTS

FR 2704588 A1 11/1994

OTHER PUBLICATIONS

Latham Pools Website, https://lathampool.com/products/pool-steps/vinyl-over-polymer.html, accessed Apr. 29, 2015.
(Continued)

*Primary Examiner* — James M Ference
(74) *Attorney, Agent, or Firm* — Tech Valley Patent, LLC; John Pietrangelo

(57) ABSTRACT

Pool stair assemblies having stair structures fabricated from plastic foam are provided. The stair structures include protective tread sheets and protective riser sheets and a vinyl pool liner mounted over the stair structure, tread sheets, and riser sheets. The stair structure, which may be buoyant, is retained in a pool by the weight of pool water on the liner and stair structure. Aspects of the invention overcome the disadvantages of conventional pool stair assemblies and ladders positioned on top of pool liners. Other related pool structures, methods of installing stair assemblies, stair structures, and methods of fabricating stair structures are also disclosed.

20 Claims, 7 Drawing Sheets

(56) References Cited

U.S. PATENT DOCUMENTS

| | | | | |
|---|---|---|---|---|
| 3,744,198 | A | 7/1973 | Boassy | |
| 3,748,810 | A | 7/1973 | Mattingly | |
| 3,952,338 | A | 4/1976 | Troxclair | |
| D240,084 | S | 5/1976 | Melchior | |
| 3,959,830 | A | 6/1976 | Van Den Broek | |
| 4,001,899 | A | 1/1977 | Mathis | |
| D254,447 | S | 3/1980 | Reineman | |
| D255,382 | S | 6/1980 | Beebe | |
| D260,288 | S | 8/1981 | D'Innocente et al. | |
| D260,429 | S | 8/1981 | Myers | |
| D264,505 | S | 5/1982 | Reineman | |
| 4,343,120 | A | 8/1982 | Witte | |
| D267,043 | S | 11/1982 | Kingsley | |
| D267,271 | S | 12/1982 | Kingsley et al. | |
| 4,466,141 | A | 8/1984 | Starkey | |
| 4,599,835 | A * | 7/1986 | Rinke | E04H 4/144 52/169.7 |
| 4,706,425 | A | 11/1987 | Brumbalough | |
| 4,713,849 | A | 12/1987 | Kindness | |
| D295,666 | S | 5/1988 | Griffiths | |
| D304,236 | S | 10/1989 | Giese et al. | |
| 4,873,802 | A | 10/1989 | Dahowski | |
| 4,955,835 | A | 9/1990 | Hollingsworth | |
| 4,981,543 | A | 1/1991 | Popovich | |
| 5,044,465 | A | 9/1991 | Rinke | |
| D321,245 | S | 10/1991 | Delepine | |
| D323,378 | S | 1/1992 | Delepine | |
| 5,092,951 | A | 3/1992 | Popovich | |
| 5,133,818 | A | 7/1992 | Popovich | |
| 5,186,874 | A | 2/1993 | McLaughlin | |
| 5,228,148 | A | 7/1993 | Weir | |
| 5,283,915 | A | 2/1994 | Idland | |
| 5,312,858 | A | 5/1994 | Folsom | |
| 5,320,568 | A | 6/1994 | Koerkel, Jr. | |
| 5,333,322 | A | 8/1994 | Weir | |
| 5,377,623 | A | 1/1995 | Parr | |
| 5,408,707 | A | 4/1995 | Wilson | |
| 5,428,849 | A | 7/1995 | Watkins | |
| 5,400,556 | A | 9/1995 | Favaron | |
| 5,448,862 | A | 9/1995 | Candiracci | |
| 5,527,412 | A | 6/1996 | Hansen | |
| D372,985 | S | 8/1996 | Bourgault | |
| 5,548,852 | A | 8/1996 | Rowe | |
| 5,606,831 | A | 3/1997 | Tippmann et al. | |
| 5,619,759 | A | 4/1997 | Hansen | |
| 5,644,873 | A | 7/1997 | Bourgault | |
| 5,678,256 | A | 10/1997 | Lea | |
| 5,695,586 | A * | 12/1997 | Stegmeier | E04H 4/142 156/245 |
| 5,709,793 | A | 1/1998 | Kisner | |
| 5,713,166 | A | 2/1998 | Couture | |
| 5,715,907 | A | 2/1998 | Andret et al. | |
| 5,741,453 | A | 4/1998 | Kennedy | |
| 5,745,934 | A | 5/1998 | Hansen | |
| 5,749,106 | A | 5/1998 | Loyd et al. | |
| 5,752,350 | A | 5/1998 | Maiuccoro | |
| 5,794,280 | A | 8/1998 | Hansen | |
| 5,794,391 | A | 8/1998 | Howard | |
| 5,799,345 | A | 8/1998 | Hansen | |
| 5,802,631 | A | 9/1998 | Friedman | |
| 5,815,854 | A | 10/1998 | Amaral et al. | |
| 5,898,957 | A | 5/1999 | Hansen | |
| 5,916,098 | A | 6/1999 | Crelin | |
| 5,916,099 | A | 6/1999 | Hall | |
| 5,941,030 | A | 8/1999 | Williamson | |
| 5,964,634 | A | 10/1999 | Chang | |
| 6,000,494 | A | 12/1999 | Wilson | |
| D431,303 | S | 9/2000 | Maiuccoro | |
| 6,115,975 | A | 9/2000 | Abdollah | |
| 6,202,787 | B1 | 3/2001 | Kessler | |
| 6,247,194 | B1 | 6/2001 | Desjoyaux | |
| 6,327,722 | B1 | 12/2001 | Noble | |
| 6,408,577 | B1 | 6/2002 | Desjoyaux et al. | |
| 6,427,403 | B1 | 8/2002 | Tambakis | |
| 6,543,191 | B1 | 4/2003 | Kress | |
| 7,011,045 | B1 | 3/2006 | Zehner | |
| 7,150,129 | B2 | 12/2006 | Elder et al. | |
| 8,028,353 | B1 | 10/2011 | Hohmann | |
| 8,112,951 | B2 | 2/2012 | Gravel | |
| 8,387,174 | B1 | 3/2013 | Gillespie | |
| 8,499,507 | B1 | 8/2013 | Saccoccio et al. | |
| 8,707,638 | B2 | 4/2014 | Keller | |
| 9,121,190 | B1 | 9/2015 | Douglas | |
| 10,240,349 | B2 | 3/2019 | Sirco et al. | |
| 10,407,929 | B1 | 9/2019 | Sirco et al. | |
| 2003/0106743 | A1 | 6/2003 | St-Pierre | |
| 2004/0020142 | A1 | 2/2004 | Kress | |
| 2004/0079297 | A1 | 4/2004 | Wolfington | |
| 2004/0144044 | A1 | 7/2004 | Cox | |
| 2004/0244724 | A1 | 12/2004 | Runge | |
| 2006/0117681 | A1 | 6/2006 | Elder | |
| 2006/0180097 | A1 | 8/2006 | Notine | |
| 2006/0218716 | A1 | 10/2006 | Prescott et al. | |
| 2006/0225372 | A1 | 10/2006 | Gonzalez | |
| 2006/0272083 | A1 | 12/2006 | Kruger | |
| 2007/0124855 | A1 | 6/2007 | Lau | |
| 2007/0220667 | A1 | 9/2007 | Kanetis | |
| 2007/0289556 | A1 | 12/2007 | Hoffman | |
| 2008/0120928 | A1 | 5/2008 | St-Pierre | |
| 2008/0134426 | A1 | 6/2008 | Cronise | |
| 2008/0169153 | A1 | 7/2008 | O'Connor | |
| 2008/0216422 | A1 | 9/2008 | Chung | |
| 2009/0107763 | A1 | 4/2009 | Poston | |
| 2009/0277104 | A1 | 11/2009 | McCool | |
| 2009/0308003 | A1 | 12/2009 | Juneau | |
| 2010/0132277 | A1 | 6/2010 | Bush | |
| 2011/0203045 | A1 | 8/2011 | Dillen, II | |
| 2012/0079651 | A1 | 4/2012 | Lafontaine | |
| 2012/0137489 | A1 | 6/2012 | Hall | |
| 2012/0167494 | A1 | 7/2012 | Brooks et al. | |
| 2013/0007956 | A1 | 1/2013 | Korbel | |
| 2013/0061450 | A1* | 3/2013 | Wherley | E04H 4/14 29/525.01 |
| 2013/0167457 | A1 | 7/2013 | Gibson | |
| 2013/0328464 | A1 | 12/2013 | Hall | |
| 2014/0069742 | A1 | 3/2014 | Lipniarski | |
| 2014/0123590 | A1 | 5/2014 | Maiuccoro | |
| 2014/0150358 | A1 | 6/2014 | St-Pierre | |
| 2014/0174005 | A1 | 6/2014 | Richard | |
| 2015/0366752 | A1 | 12/2015 | Hatley | |

OTHER PUBLICATIONS

Amazon.com Website: Blue Wave Above Ground Swimming Pools, http://www.amazon.com/Blue-Above-Ground-Swimming-Pools/dp/B004WWG3DU, accessed Apr. 30, 2015.

Amazon.com Website: Wedding Above Ground Swimming Pools, http://www.amazon.com/Blue- http:/ /www.amazon.com /Wedding-Above-Ground-SwimmingPools/dp/B00JDCMNPQ/ref=sr_1_14?ie= UTF8&qid=1430138727&sr=814&keywords=above+ground+pools+steps, accessed Apr. 30, 2015.

Office Action for parent U.S. Appl. No. 14/844,753 dated Mar. 28, 2017, 38 pages.

Alpha Pool Product publication (published Jul. 15, 2014) Accessed Mar. 20, 2017 http://onlyalphapoolproducts.blogspot.com/2014/07/vinyl-liner-inground-pools-step-options.html#!/2014/07/vinyl-liner-inground-pools-step-options.html.

Office Action for parent U.S. Appl. No. 14/844,753 dated Apr. 20, 2018, 24 pages.

Office Action for parent U.S. Appl. No. 14/844,753 dated Jul. 18, 2017, 20 pages.

Office Action for parent U.S. Appl. No. 14/844,753 dated Jul. 30, 2018, 26 pages.

Office Action for parent U.S. Appl. No. 14/844,753 dated Nov. 17, 2016, 17 pages.

Office Action for parent U.S. Appl. No. 14/844,753 dated Dec. 5, 2017, 14 pages.

Office Action for parent U.S. Appl. No. 14/844,753 dated Dec. 20, 2018, 7 pages.

Office Action for parent U.S. Appl. No. 14/844,753 dated Oct. 26, 2016, a Restriction, 6 pages.

(56) References Cited

OTHER PUBLICATIONS

Office Action for parent U.S. Appl. No. 16/285,488 dated Apr. 3, 2019, 21 pages.

* cited by examiner

POOL STAIR ASSEMBLIES AND METHODS OF INSTALLING A POOL STAIR ASSEMBLY

CROSS-REFERENCE TO RELATED APPLICATIONS

This application is a continuation application of U.S. application Ser. No. 16/285,488, filed on Feb. 26, 2019, now U.S. Pat. No. 10,407,929, which is a divisional application of U.S. application Ser. No. 14/844,753, filed on Sep. 3, 2015, now U.S. Pat. No. 10,240,359, which claims priority from U.S. Provisional Patent Application 62/048,618 filed on Sep. 10, 2014, the disclosures of which are incorporated by reference herein in their entirety.

BACKGROUND OF THE INVENTION

Technical Field

The present invention is generally concerned with swimming pool stair assemblies, and more specifically to swimming pool stair assemblies having buoyant stair structures and a pool liner mounted over the structure that are retained by the weight of pool water.

Description of Related Art

Swimmers and bathers typically access swimming pools and other water-bearing structures via some form of ladder or stair assembly. Most are familiar with the common ladder structure that mounts over the wall of the backyard above-ground pool or of the cascading stair assembly or concrete structure that is positioned within an in-ground pool. Though common in the art and convenient for the bather, these conventional structures have recognized limitations manifest during installation in the pool, during pool use, and while maintaining the pool and ladder or stair, among other disadvantages.

Typically, conventional in-ground and above-ground pool assemblies may be lined with a water-impermeable plastic, "vinyl" liner that retains the pool water. This liner may be used in both in-ground pools over a suitable foundation, such as, sand or gunite, and in above-ground installations mounted to the walls enclosing the above-ground pool. As is well known in the art, these relatively thin vinyl liners are typically a continuous concern for the installer, the owner, and the user of the pool. Inadvertent damage or perforation of the liner can lead to pool water leakage, at a minimum; and, in a worst case, to an end to a pleasant swimming experience.

Conventional swimming pool access ladders and stair assemblies are typically mounted over and bear against the pool liner in both above-ground and in-ground pools. As known in the art, during installation and use of these ladders and stair assemblies care must be practiced to avoid damaging the liner. Accordingly, the installation and use of ladders and stairs mounted over the liner often require continuous care and monitoring during installation and use to avoid damaging the liner.

In addition, conventional ladders and stairs can be less than aesthetically pleasing to the user and pool owner. Conspicuous A-frame-shaped pool ladders are a common, less-than-ideal backyard structure. Drop-in pool stair assemblies, though typically out of sight, inherently provide undesirable gaps or inconsistencies with the pool liner that the stair assembly abuts or rests on. Moreover, such prior art ladders and drop-in stair assemblies can interfere with cleaning and maintenance of the pool, and can pose a safety risk to bathers.

Various attempts have been made in the art to provide swimming pool stairs. For example, U.S. Pat. No. 5,644,873 of Bourgault; U.S. Pat. No. 4,599,835 of Rinke; and U.S. Pat. No. 8,499,507 of Sacciccio, et al. each discloses some form of pool stair assembly, typically, for use in above-ground pools. However, like other prior art, these references disclose stair assemblies positioned above the pool liner that are prone to the disadvantages discussed above. U.S. Patent Published 2012/0167494 of Brooks, et al. discusses a modular pool stair case system. However, the intricate ABS-plastic design of this stair structure make it unwelcome to installers and likely expensive to pool purchasers.

Aspects of the present invention overcome these and other disadvantages of the prior art.

SUMMARY OF THE INVENTION

The present invention provides lightweight swimming pool stair assemblies that can be installed beneath a pool liner and be retained in the pool by the weight of the pool water on the pool liner. In one aspect, a stair assembly is provided having a lightweight, plastic foam structure or substructure that can be readily and easily handled and manipulated by the pool installer and then retained beneath the pool liner. Among other things, this concealment of the stair structure beneath the liner eliminates potentially damaging contact with the liner, provides a more uniform aesthetically pleasing appearance to the stair assembly and the pool, minimizes safety concerns to bathers, and facilitates cleaning and maintenance of the pool. Aspects of the invention are adaptable to above-ground swimming pools, partially-in-ground swimming pools, and in-ground swimming pools, among other water bearing structures requiring ingress and/or egress of swimmers or bathers.

One embodiment of the invention is a pool stair assembly comprising or including a stair structure comprising a plastic foam and having a plurality of steps; and a liner mounted over the stair structure, wherein each of the plurality of steps is covered by a portion of the liner; wherein when positioned beneath the surface of water in a pool, the weight of the water upon the liner retains the pool stair assembly in the pool. In one aspect, the stair structure is buoyant in water, for example, the stair structure comprises a plastic foam. In another aspect, the buoyant, plastic foam structure consists of the plastic foam, for example, with no other material except the plastic foam.

According to one aspect of the invention, stair assemblies may be provided requiring little or no attachment to or retention to a pool foundation or a pool wall. For example, in one aspect, the pool stair assembly may be "self-retaining," for example, requiring little or no hardware to retain the stair assembly in a pool.

In one aspect, the buoyant, plastic foam stair structure comprises a plurality of plastic foam blocks, for instance, where each of the plurality of plastic foam blocks defines one of the plurality of steps of the stair structure.

In another aspect of the invention, each of the plurality of steps includes a tread sheet and a riser sheet, for example, the tread sheets and the riser sheets may each comprise a fiber-reinforced plastic. The riser sheets and the tread sheets may be protective of the typically softer foam.

In a further aspect of the invention, the pool stair assembly comprises a pool stair assembly for an in-ground swimming pool, a partially-in-ground swimming pool, or an above-ground swimming pool.

Another embodiment of the invention is a method of installing a pool stair assembly into a pool, the method comprising or including: preparing a foundation for the pool; erecting at least a partial wall of the pool; positioning a stair structure comprising a plastic foam and having a plurality of steps onto the foundation and adjacent the at least partial wall of the pool; mounting a liner over the stair structure wherein each of the plurality of steps is covered by a portion of the liner; and introducing water to the pool wherein the weight of the water upon the liner retains the buoyant pool stair assembly in the pool.

In one aspect, the step of positioning the stair structure onto the foundation and adjacent to the at least partial wall of the pool is practiced without retaining the stair structure with hardware, wherein only the weight of the water upon the liner substantially retains the pool stair assembly in the pool.

In another aspect, the positioning of the stair structure comprises positioning a buoyant, plastic foam stair structure having a tread sheet and a riser sheet on each of the plurality of steps.

In another aspect of the invention, erecting at least a partial wall of the pool comprises erecting substantially a complete wall of the pool.

In another aspect, mounting the liner over the stair structure may be practiced by engaging the liner with liner-retaining devices on the stair structure.

A further embodiment of the invention is a pool stair assembly comprising or including a stair structure having a plurality of plastic foam steps, each of the plurality of plastic foam steps having a plastic tread sheet and a plastic riser sheet; and a liner mounted over the stair structure, wherein each plastic tread sheet and each plastic riser sheet of the plurality of plastic foam steps is covered by a portion of the liner; wherein when positioned beneath the surface of water in a pool, the weight of the water upon the liner retains the pool stair assembly in the pool. The stair assembly may be a buoyant stair assembly.

In one aspect, each of the plurality of plastic foam steps comprises a plastic foam block, for example, an expanded polystyrene foam block.

In another aspect, the plastic tread sheets and the plastic riser sheets comprise a fiber-reinforced plastic.

In another embodiment, the pool stair assembly comprises a pool stair assembly for an in-ground swimming pool, a partially-in-ground swimming pool, or an above-ground swimming pool.

A further aspect of the invention is a pool stair structure comprising or including one or more blocks forming a plurality of steps, the one or more blocks comprising a material having a specific gravity less than 1.0; a plurality of riser sheets, each of the plurality of the riser sheets mounted to a riser of each of the plurality of steps; and a plurality of tread sheets, each of the plurality of the tread sheets mounted to a tread of each of the plurality of steps. In one aspect, the material having a specific gravity less than 1.0 comprises a plastic foam, for example, an expanded polystyrene foam. In another aspect, the pool stair structure may further include a plurality of liner-retaining devices, each of the plurality of liner-retaining devices mounted to one of the plurality of steps.

A still further aspect of the invention is a method of fabricating a pool stair structure, the method comprising or including: forming a plurality of steps from one or more blocks, the one or more blocks comprising a material having a specific gravity less than 1.0; mounting a riser sheet to a riser of each of the plurality of steps; and mounting a tread sheet to a tread of each of the plurality of steps.

In one aspect of this embodiment, the forming of the plurality of steps may comprise forming the plurality of steps from a plurality of blocks, for example, from foam blocks. In another aspect, mounting the riser sheet and mounting the tread sheet may be practiced using an adhesive. In another aspect, the method may further include mounting a liner-retaining device to each of the plurality of steps.

These and other aspects, features, and advantages of this invention will become apparent from the following detailed description of the embodiments and the various aspects of the invention taken in conjunction with the accompanying drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention will be readily understood from the following detailed description of the embodiments and the aspects of the invention taken in conjunction with the accompanying drawings in which:

DETAILED DESCRIPTION OF THE INVENTION

Figure 1:
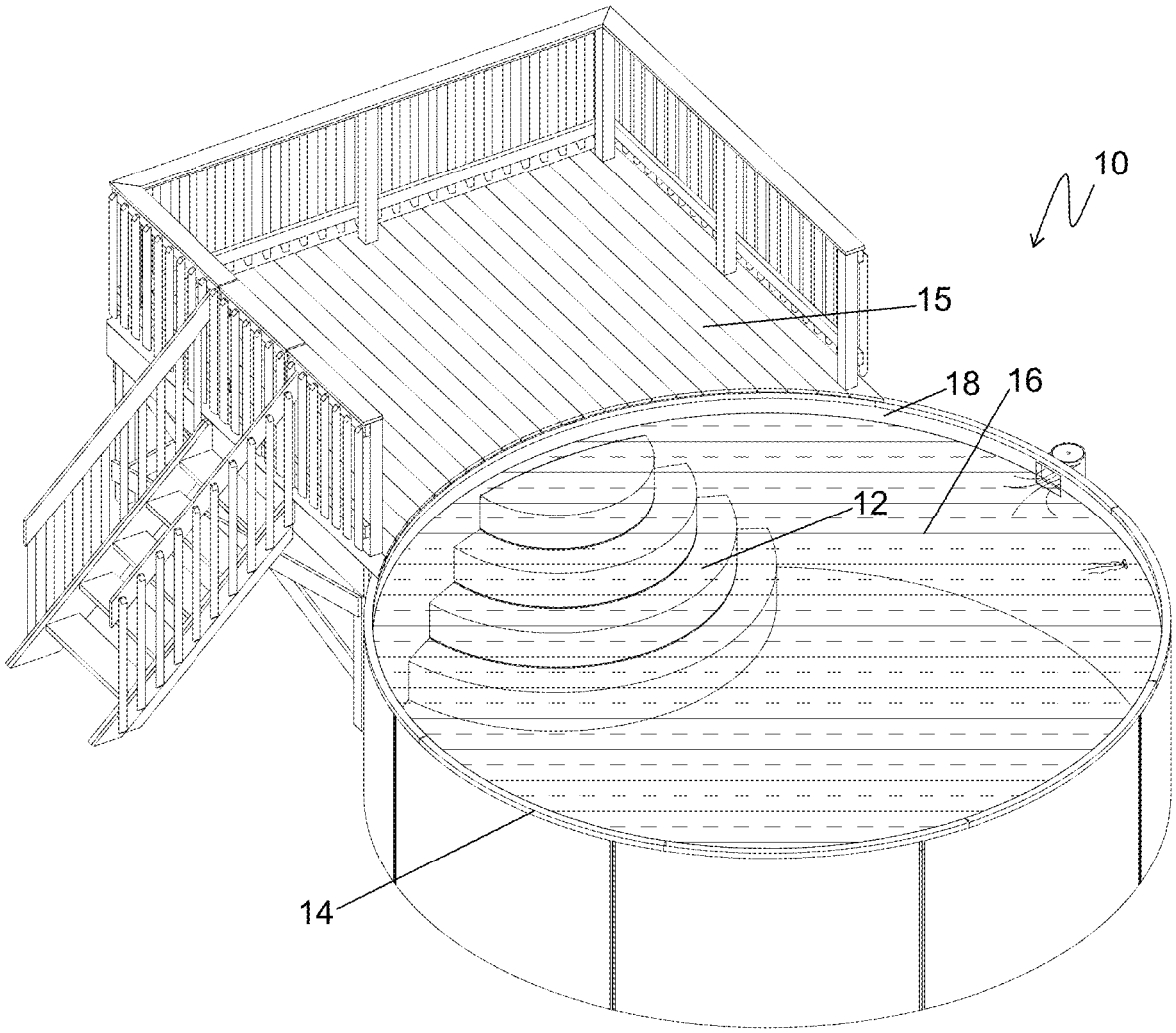
FIG. 1 is a perspective view of a typical installation of a stair assembly according to an aspect of the invention in an above-ground pool.

FIG. 1 is a perspective view of a typical installation 10 of a pool stair assembly 12 according to one embodiment of the invention as positioned in an above-ground pool 14 containing water 16. As shown in FIG. 1, stair assembly 12 is adapted to be positioned against an internal surface 18 of pool 14, for example, against an internal wall or the internal surface of one or more pool panels of pool 14. FIG. 1 also includes a representative surface or deck 15, for example, a wooden deck, that may be provided and positioned adjacent to stair assembly 12, for example, to facilitate access to stair assembly 12 by swimmers or bathers (not shown) entering or leaving pool 14.

Though the embodiment of the invention shown in FIG. 1 is positioned in an above-ground pool 14, other embodiments of the present invention may be installed in a partially- or semi-above-ground pool or in an in-ground pool. In one aspect, pool 14 may be a pool provided by Radiant Pools of Albany, N.Y., for example, a Radiant Pools Metric Series pool, such as, a pool disclosed in U.S. Published Patent Application 2008/0104745 of Beaudoin, et al. or a pool disclosed in U.S. Published Patent Application 2014/0208687 of Foster, et al., both of which are included by reference herein. Other embodiments of the present invention may be used in any type of pool or water-containing enclosure.

In addition to pools, for example, backyard swimming pools, aspects of the invention may also be employed in spas, exercise pools, physical therapy pools, tubs, or any water-containing enclosure that may benefit from the function, ease of installation, and aesthetic appearance of aspects of the present invention. Other aspects of the invention may be used along shorelines, for example, along the shore of a lake, pond, river, or even along an ocean shore or beach.

Figure 2:
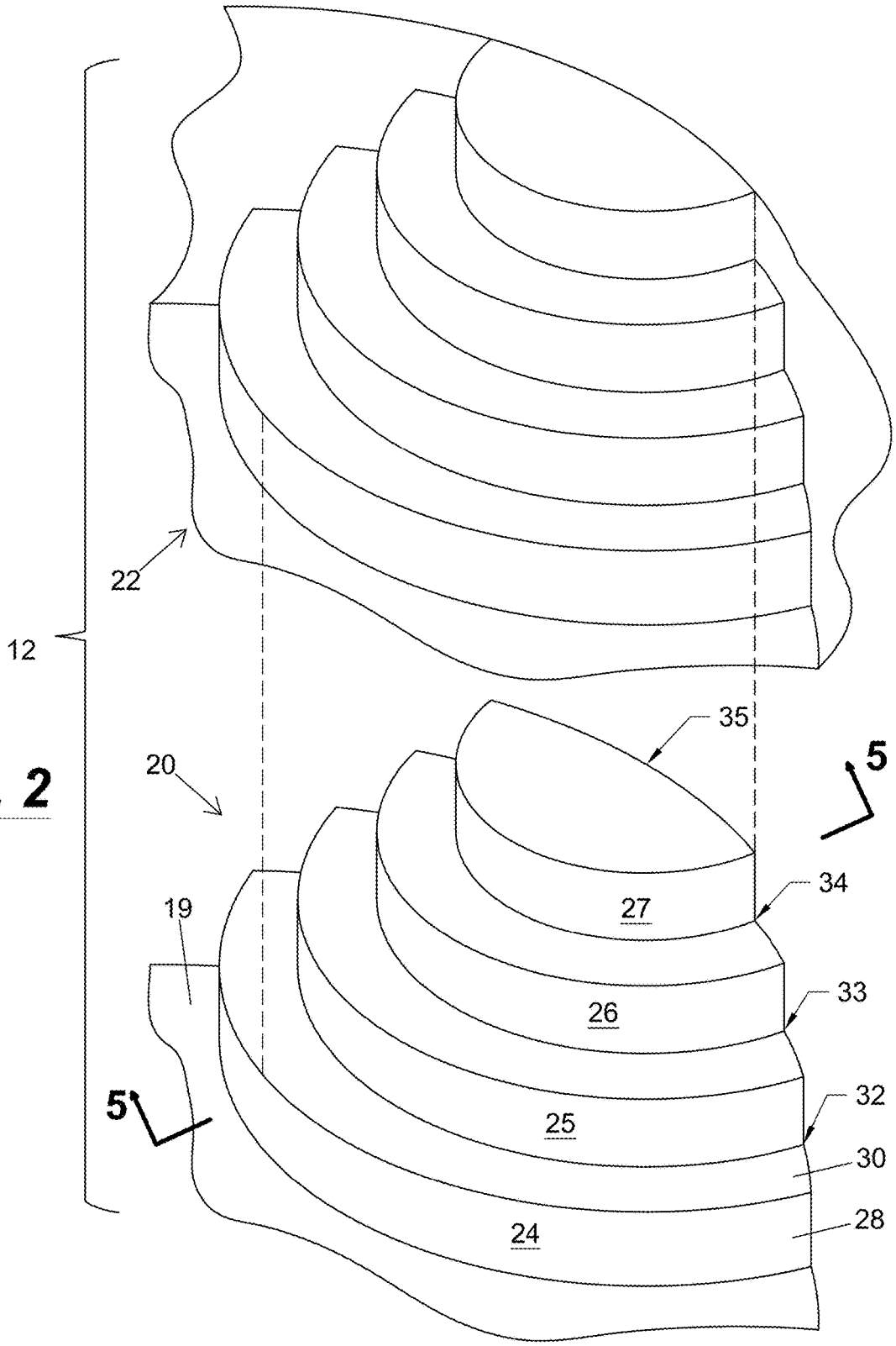
FIG. 2 is an exploded perspective view of the stair assembly shown in FIG. 1.

FIG. 2 is an exploded perspective view of stair assembly 12 shown in FIG. 1. As shown in FIG. 2, stair assembly 12 includes a stair structure or stair substructure 20 adapted to be positioned adjacent internal surface 18 (see FIG. 1), for example, abutting internal surface 18, and a cover or liner 22 that covers stair structure 20 and may cover a portion of internal surface 18. Stair structure 20 may typically be mounted on base or foundation 19, for example, a leveled, sand foundation. As shown in FIG. 2, stair structure 20 includes a plurality of steps 24, 25, 26, and 27. Though four (4) steps are shown in FIG. 2, aspects of the present invention may include 1 or more steps 24, 25, 26, and 27. Aspects of the invention may include one or more steps, or 2 or more steps, such as, 5 or more steps, 10 or more steps. Each of steps 24-27 includes a front surface or "riser" 28 and a top surface or "tread" 30, as representatively shown for step 24 in FIG. 2.

Liner 22 may be a conventional swimming pool-type liner, for example, a "vinyl" liner, that is, a thin flexible sheet of polyvinyl chloride (PVC) thermoplastic, as known in the art. The liner typically has a thickness ranging from 0.010 to about 0.050 inches, for instance, about 0.020 inches or about 0.030 inches. According to aspects of the invention, liner 22 may be uniquely tailored to the shape of stair structure 20. For example, liner 22 may be formed to conform to the shape and dimensions of stair structure 20 and the internal surface 18 of pool 14 to provide a watertight cover about stair structure 20. Typically, in order to minimize interfaces that may be potential source of leaks, liner 22 may be fabricated as a portion of a liner that encompasses the entire pool 14. For example, liner 22 may be fabricated by cutting individual vinyl pieces (for example, with a computerized numerically controlled (CNC) device) sized to cover stair structure 20 and then fusing the individual pieces, for instance, by welding, to form the desired shape of liner 22 about stair structure 20. In one aspect of the invention, liner 22 may be a liner provided by Imperial Pools of Latham, N.Y., or its equivalent, though other suppliers may be used.

As also shown in FIG. 2, at least some of steps 24-27, but typically all of the steps 24-27, may include some form of liner-retaining device or track 32, 33, 34, and 35. Liner-retaining devices 32-35 are adapted to engage liner 22 and at least partially retain liner 22 on steps 24-27 to, for example, avoid relative movement or slippage of liner 22. For example, in one aspect, liner 22 may include protrusions or "beads" beneath liner 22 which are positioned and sized to be received and retained in retaining devices 32-35 in steps 24-27 (see FIGS. 6A and 6B). In another aspect, stair assembly 12 may include retaining strips or bars sized and adapted to engage and retain portions of liner 22 within liner-retaining devices 32-35.

Retaining devices 32-35 may typically be mounted in or on the treads 30 of steps 24-27, but retaining devices 32-35 may also be mounted in or on the risers 28 of steps 24-27. Though many conventional liner-retaining devices may be used for devices 32-35, in one aspect, liner retaining deices 32-35 may be conventional track-type devices, such as, those provided by Vastec of Brantford, Ontario, Canada, for example, track part number 3313A-120-W, or its equivalent. In one aspect, steps 24-27 may include horizontally ("HZ")-oriented, liner-retaining tracks or vertically ("VT")-oriented, liner-retaining tracks. For example, in the embodiment shown in FIG. 2, liner-retaining devices 32, 33, and 34 may be HZ-oriented, liner-retaining tracks while retaining device 35 (or the upper-most retaining device) may be a VT-oriented, liner-retaining track.

Figure 3:
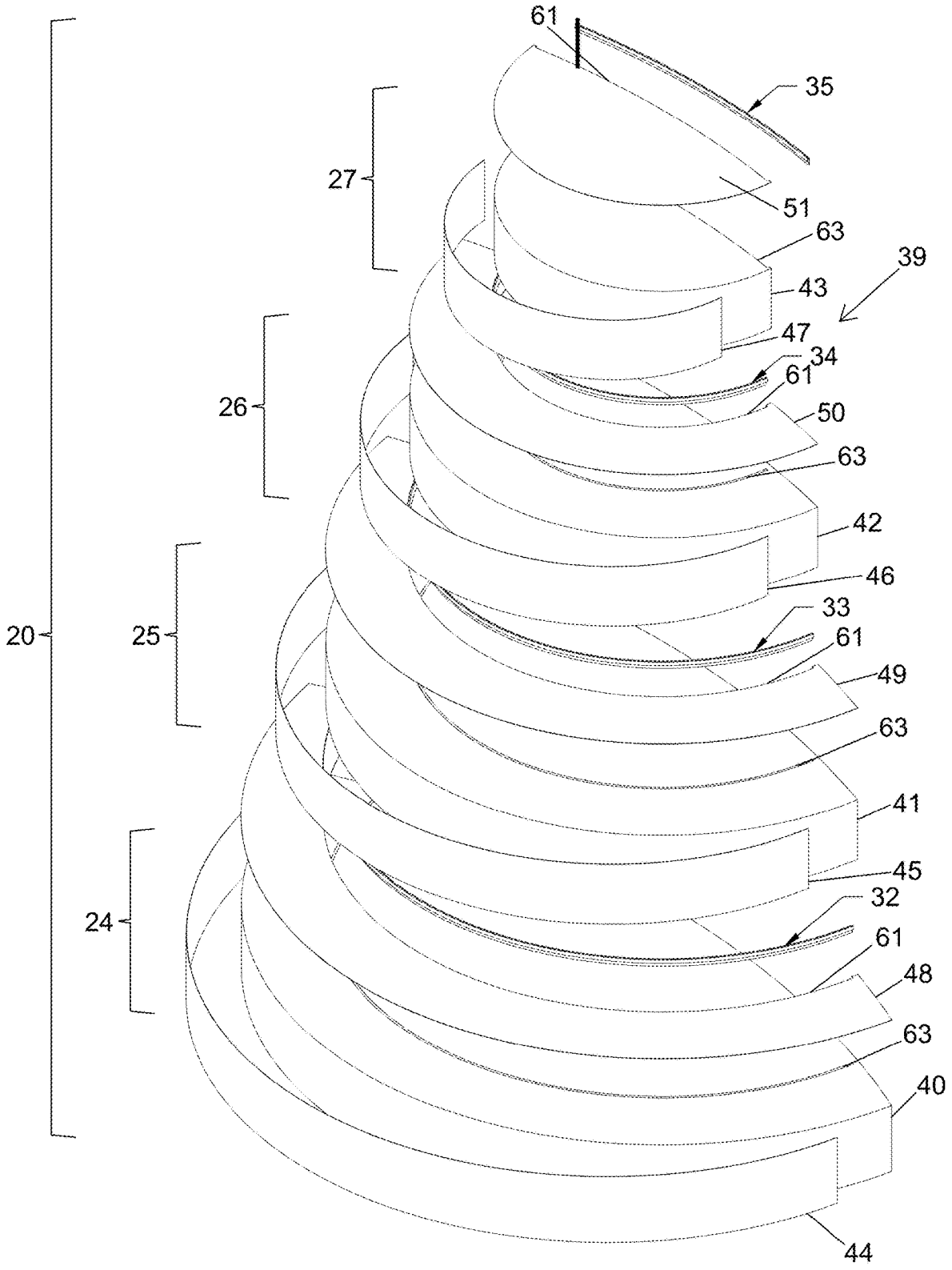
FIG. 3 is an exploded perspective view of the stair structure shown in FIG. 2.

FIG. 3 is an exploded perspective view of the stair structure 20 shown in FIG. 2. According to one aspect of the invention, stair structure 20 may comprise a single, integral body or block 39 defining the shape and location of steps 24-27. As shown in FIG. 3, in another aspect, integral body or block 39 may comprise 2 or more separate bodies or blocks 40, 41, 42, and 43, respectively. The separate bodies or blocks 40-43 may be attached to each other by conventional means, for example, with mechanical fasteners or an adhesive. In one aspect, the plurality of bodies or blocks 40-43 may be of an appropriate density, for example, having a specific gravity less than the specific gravity of water (for example, tap or mains water) under the prevailing ambient atmospheric conditions (for example, a collective specific gravity less than 1.0), and a sufficient hardness or durability to provide the desired structure of stair structure 20, where no other components may be necessary. However, in the aspect of the invention shown in FIG. 3, integral body or block 39 or plurality of bodies 40-43 may comprise a material (for example, a polyester foam, such as, an expanded polystyrene foam [EPF]) that, due to the malleability or softness of the material, may require a protective sheet, panel, or cover. Accordingly, in one aspect, block 39 or individual blocks **4*o*-43 may be provided with front or riser sheets or panels 44, 45, 46, and 47 associated with each step 24-27, respectively; and/or top or tread sheets or panels 48, 49, 50, and 51, respectively, associated with each step 24-27, respectively. Accordingly, though in one aspect, no riser sheets 44-47 or tread sheets 48-51 may be needed, in another aspect, as shown in FIG. 3, riser sheets 44-47, or tread sheets 48-51**, or both riser sheets and tread sheets may be provided.

In one aspect of the invention, tread sheets 44-47 may substantially completely cover the top surface of the individual bodies or blocks **4*o*-43 to which it is mounted. However, in other aspects of the invention (for example, as shown in FIG. 3), tread sheets 48, 49, and 50 may be sized and shaped to only cover the exposed tread region of blocks 40-42, respectively. Accordingly, as shown in FIG. 3, tread sheets 48-50 may include an internal radius (radius "R3" in FIG. 4) or be otherwise sized to conform to the shape or radius of the adjoining step 41, 42, or 43, respectively. As also shown in FIG. 6, the upper-most tread sheet 51, or the tread sheet not positioned adjacent a step riser 28) may not include an internal radius, but may be shaped to substantially conform to the shape of the block (for example, block 43) to which the tread sheet 51** is mounted.

According to one aspect of the invention, the lower-most block 40 may be referred to as "the foundation block," and the subsequent blocks 41-43 may be similar in shape to but sequentially smaller in dimension than foundation block 40. When mounted on foundation block 40, blocks 40-43 provide the desired stair step formation.

According to aspects of the invention, integral body 39 or separate bodies or blocks 40-43 may be made from any material sufficient to withstand the loading expected, for example, the foot traffic of bathers entering and leaving the pool into which aspects of the invention may be used. Accordingly, integral body 39 or separate bodies 40-43 may be made from a metal, a plastic or polymer, or even wood and provide the benefits of aspects of the invention. For example, in one aspect, integral body 39 or separate bodies 40-43 may be made of a metal, for example, a hollow metallic body having a metallic frame and covered by a metallic, plastic or wood cover, for instance, metallic, plastic, or wood riser sheets 44-47 and tread sheets 48-51. The metallic frame may encase or enclose bodies or blocks having lower specific gravity, such as, expanded polystyrene foam, where the metallic frame and enclosed bodies are collectively buoyant, for example, have a collective specific gravity less than 1.0. (When used here and elsewhere herein, it is to be understood that when reference is made to a specific gravity less than the 1.*o*, it may be understood to mean having a specific gravity less than the specific gravity of water (for example, tap or mains water) under the prevailing ambient atmospheric conditions.)

In another aspect, integral body 39 or separate bodies 40-43 may be made from a plastic, for example, a hollow plastic body having a plastic frame and covered by a metallic, plastic, or wood cover, for instance, metallic, plastic, or wood riser sheets 44-47 and tread sheets 48-51. Again, the hollow plastic body or frame may encase or enclose bodies or blocks having lower specific gravity, such as, expanded polystyrene foam, where the plastic frame and enclosed bodies are collectively buoyant, for example, have a collective specific gravity less than 1.0.

In another aspect, integral body 39 or separate bodies 40-43 may be made from a wood, for example, a hollow wood body having a wooden frame and covered by a metallic, plastic, or wood cover, for instance, metallic, plastic, or wood riser sheets 44-47 and tread sheets 48-51. The wood frame may encase or enclose bodies or blocks having lower specific gravity, such as, expanded polystyrene foam, where the wood frame and enclosed bodies are collectively buoyant, for example, have a collective specific gravity less than 1.0.

In another aspect, which is envisioned to provide the lightest weight structure, integral body 39 or separate bodies 40-43 may made from a lightweight plastic foam, for example, a polystyrene foam or a polyurethane foam, such as, an expanded polystyrene [EPS] foam, an expanded polyurethane foam, or their equivalent. The foam structure may be a substantially solid foam structure or a foam structure having voids or openings therein. The plastic foam structure may be covered by a metallic, plastic, or wood cover, for instance, metallic, plastic, or wood riser sheets 44-47 and tread sheets 48-51. The foam structure, and any riser sheets 44-47 and tread sheets 48-51 are preferably collectively buoyant, for example, have a collective specific gravity less than 10.

The plastic foam may have a density ranging from 0.5 pounds per cubic foot [pcf] to about 5.0 pcf, but may typically have a density of abut 1.0 to about 3.0 pcf, for example, about 2.0 pcf.

Riser sheets 44-47 and tread sheets 48-51 may comprise a material having a hardness and/or a durably that exceeds the hardness and/or the durability of integral body 39 or separate bodies 40-43 (for example, comprising a plastic foam). In one aspect, riser sheets 44-47 and tread sheets 48-51 may be metallic, for example, an aluminum (such as, a epoxy-coated aluminum) or a steel (such as, an epoxy coated steel) or a stainless steel (such as, an epoxy coated stainless steel). However, in another aspect, riser sheets 44-47 and tread sheets 48-51 may be made from a plastic, for example, a polyamide (PA), for example, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); a polycarbonate (PC); or a polyvinylchloride (PVC); among other plastics. In one aspect, riser sheets 44-47 and tread sheets 48-51 may be a fiber-reinforced plastic [FRP], for example, FRP supplied by a Kal-Lite of Bow, N.H., or its equivalent.

Riser sheets 44-47 and tread sheets 48-51 may share a common thickness or vary in thickness, for example, in one aspect, riser sheets 44-47 may comprise a first thickness and tread sheets 48-51 may comprise a second thickness, different from the first thickness of riser sheets 44-47. According to aspects of the invention, regardless of the material from which they are made, riser sheets 44-47 and tread sheets 48-51 may each have a thickness ranging from about 0.020 inches to about 0.5 inches, but typically have a thickness between about 0.045 inches 0.125 inches. In one aspect, when riser sheets 44-47 and tread sheets 48-51 comprise a fiber-reinforced plastic, riser sheets 44-47 may typically have a thickness of between 0.040 inches and about 0.075 inches, for example, about 0.060 inches, and tread sheets 48-51 may typically have a thickness of between 0.100 inches and about 0.130 inches, for example, about 0.120 inches.

Riser sheets 44-47 and tread sheets 48-51 may be mounted to integral body 39 or separate bodies 40-43 by mechanical fasteners, such as, nails or screws, or with an adhesive, for example, an adhesive provided by 3M, such as, 3M Fastbond 30, or its equivalent.

Figure 6A:
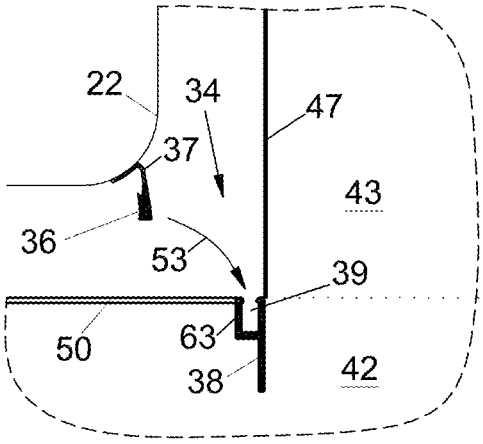
FIGS. 6A and 6B are detailed cross-sectional views of a step having a liner-retaining device identified by Detail 6 in FIG. 5 according to one aspect of the invention.
Figure 6B:
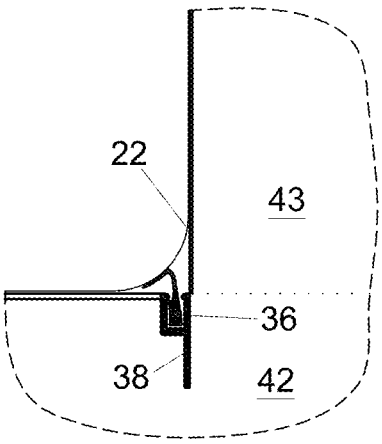

As also shown in FIG. 3, stair structure 20 may include liner-retaining devices 32, 33, 34, and 35. In one aspect, liner retaining devices 32, 33, 34, and 35 may be mounted on or in tread sheets 48-51 and/or mounted on or in bodies 40-43, and be adapted to receive and retain liner 22 (not shown in FIG. 3). In addition to securing the liner 22 to stair structure 20, liner-retaining devices 32-35 may also assist in smoothing the contact of liner 22 to stair structure 20, for example, to eliminate undesirable wrinkles or deformations of liner 22 when liner 22 is mounted to stair structure 20. As shown in FIG. 3, tread sheets 48-51 may include cutouts or recesses 61 shaped and positioned to accommodate or receive retaining devices 32-35. Also, as shown in FIG. 3, integral body 39 or individual bodies 40-43 may include one or more recesses 63 shaped and positioned to accommodate or receive retaining devices 32-35 See FIGS. 6A and 6B illustrate one example of a liner-retaining device that may be used for aspects of the invention.

Figure 4:
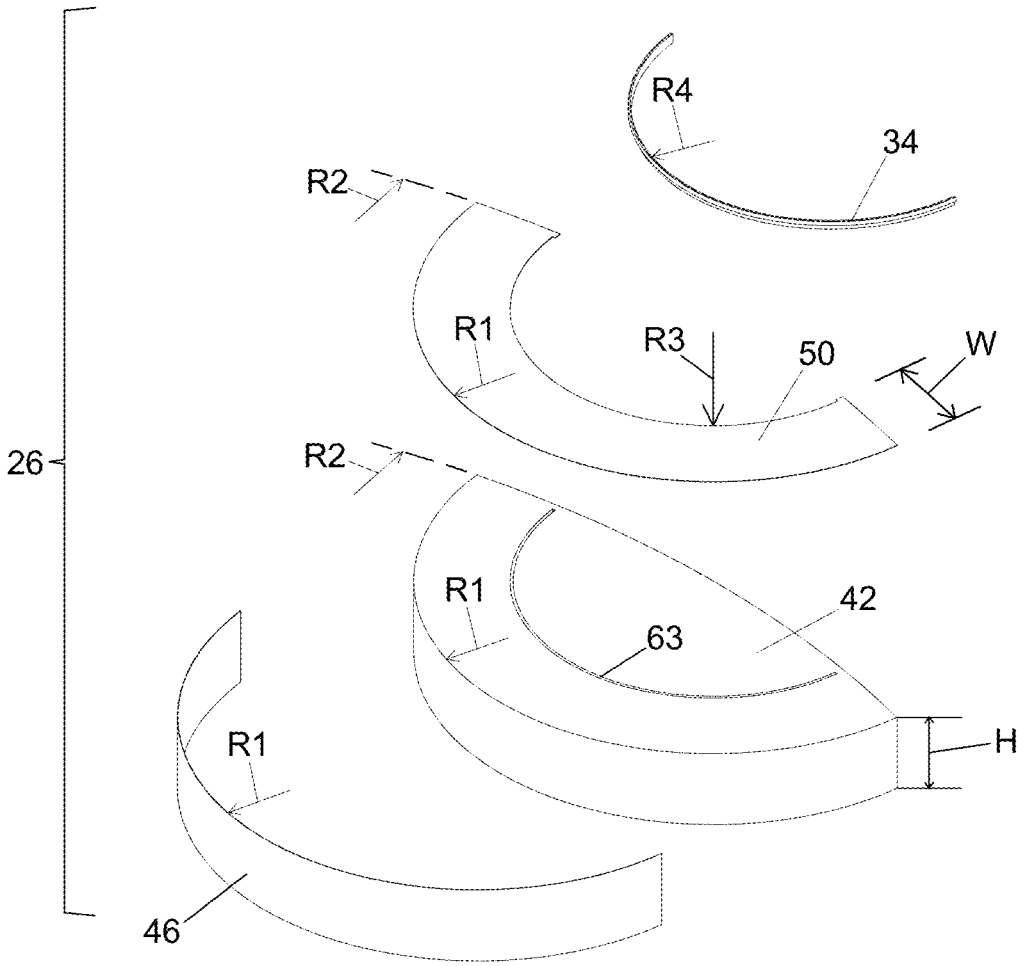
FIG. 4 is an exploded perspective view of a representative step of the stair structure shown in FIG. 3.

FIG. 4 is an exploded perspective view of a representative step 26 of steps 24-27 of the stair structure 20 shown in FIG. 3. Though steps 24-27 may be provided in a single integral body 39, in the aspect shown in FIG. 4, steps 24-27 may comprise individual bodies or blocks 42, each individual block having a riser sheet 46, a tread sheet 50, and a liner-retaining device 34. As also shown in FIG. 4, steps 24-27 may have an internal radius of curvature R1 (that is, "internal" to stair structure 20), and an external radius of curvature R2 (that is, "external" to stair structure 20), a tread sheet internal radius R3, a liner-retaining device radius of curvature R4, a tread width W, and a riser or step height H. The internal radius R1 may vary broadly and, due to the construction of steps 24-27, block 42, riser 46, and tread sheet 50 may each have substantially the same internal radius R1. According to aspects of the invention, internal radius R1 may range from about 6 inches to about 36 feet depending upon, among other things, the number of steps, the depth of the pool or water-containing enclosure, and the radius of the pool or water-containing enclosure. However, the internal radius R1 may typically range from about 1 foot to about 3 feet, for example, about 2 feet.

In one aspect, internal radius R1 may not be constant but may vary. In this aspect, body 42, riser sheet 46, and tread sheet 50 may have a varying radius R1, for example, defining a varying convex surface of body 42 and/or a varying concave surface of body 42, or both. In one aspect, internal radius R1 may not be radiused but define a linear or planar surface, for example, the internal surface of body 42, riser sheet 46, and tread sheet 50 may be substantially linear or planar.

The external radius R2 may also vary broadly and typically is about equivalent to the radius of the pool into which aspects of the invention are installed. For example, the surfaces of body 42 having the radius R2 may typically abut the internal wall surface of the pool (see wall 18 in FIG. 1), and thus be substantially the same radius as the internal wall (though R2 may vary from the radius of the internal wall surface). Accordingly, external radius R2 may range from about 6 feet to about 120 feet depending upon, among other things, the radius of the pool or water-containing enclosure. However, the external radius R2 may typically range from about 6 foot to about 20 feet, for example, about 8 feet.

In one aspect, external radius R2 may not be constant but may vary. In this aspect, body 42 and tread sheet 50 may have varying radius R2, for example, defining a varying convex surface of body 42 and/or a varying concave surface of body 42, or both.

In one aspect of the invention, for example, when the wall 18 of the pool 12 in which stair assembly 20 is not curved or radiused, that is, the pool wall 18 may be substantially planar, the surface of stair assembly 20 associated with radius R2 may also be planar. In other words, in one aspect, the radius R2 may not be radiused but may define a substantially linear edge or planar surface of stair assembly 20 that abuts a substantially planar surface of pool wall 18.

The internal radius R3 of tread sheet 50 may vary broadly and typically is about equivalent to the radius of the adjoining step. For example, as shown in FIG. 3, the internal radius R3 of tread sheet 50 may typically be about the same as the external radius R1 of adjoining block 42. Accordingly, internal radius R3 may range from about 6 inches to about 36 feet. However, the internal radius R3 of tread sheets 48-50 may typically range from about 1 foot to about 3 feet, for example, about 2 feet.

The liner-retaining device radius R4 may also vary broadly, and—as shown most clearly in FIGS. 2 and 3—is typically approximately the same radius of curvature of the adjoining step. For example, as shown in FIG. 3, the radius R4 of liner retaining device 34 is slightly larger (for example, 0.5 to 6 inches larger) than the internal radius R1 of adjoining body 43, riser sheet 47, and tread sheet 51. Accordingly, liner-retaining device radius R4 may range from about 6 inches to about 36 feet depending upon, among other things, the number of steps, the depth of the pool or water-containing enclosure, and the radius of the pool or water-containing enclosure. However, the retaining device radius R4 may typically range from about 1 foot to about 3 feet, for example, about 2 feet.

In one aspect, radius R4 may not be constant but may vary. In this aspect, radius R4 may vary to accommodate a varying radius of the adjacent body (for example, the shape of body 43, see FIG. 3, adjacent to retaining device 34). Radius R4 may define a varying convex-shaped retainer, and/or a varying concave surface retainer, or both. In one aspect, liner-retaining device 34, and other liner-retaining devices disclosed herein, may be substantially linear, that is, having little or no radius of curvature R4.

The riser or step height H may also vary broadly, and may be limited to conventional ergonomic step dimensions. According to aspects of the invention, a riser or step height H may range from about 3 inches to about 12 feet depending upon, among other things, the number of steps and the depth of the pool or water-containing enclosure. However, a riser or step height H may typically range from about 2 inches to about 15 inches, for example, about 10 inches. The tread or step width W may also vary broadly, and may be limited to conventional ergonomic step dimensions. According to aspects of the invention, a tread or step width W may range from about 3 inches to about 12 feet depending upon, among other things, the number of steps and the width or diameter of the pool or water-containing enclosure. However, a tread or step width W may typically range from about 2 inches to about 15 inches, for example, about 10 or 12 inches.

Figure 5:
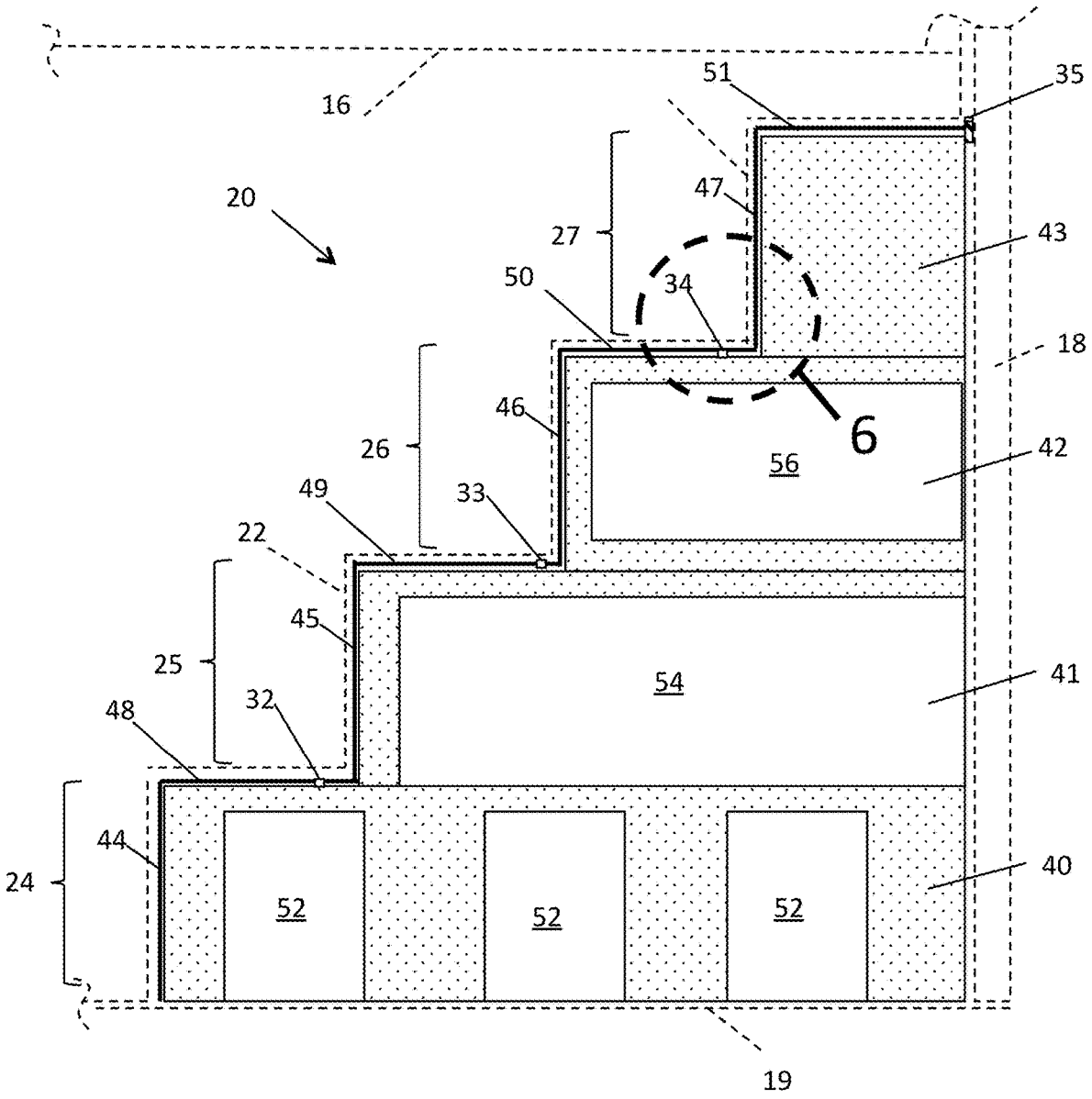
FIG. 5 is a cross-sectional view of the stair structure shown in FIG. 2 as viewed along section lines 5-5 in FIG. 2.

FIG. 5 is a cross-sectional view of the stair structure 20 shown in FIG. 2 as viewed along section lines 5-5 in FIG. 2. A representative portion of liner 22 mounted on stair structure 20 is shown in phantom in FIG. 5 for reference. Liner retaining devices 32, 33, 34, and 35, which are positioned and adapted to retain liner 22, are also shown. Pool wall 18 and pool foundation or base 19 are shown in phantom for reference in FIG. 5. A representative level of water 16 retained by wall 18 of pool 14 is also shown in phantom.

As shown in FIG. 5, internal bodies or blocks 40-43 (or single internal integral body 39) of stair structure 22 may comprise a broad range of structures. For example, in one aspect, one or more of bodies 40-43 may comprise a solid block, for instance, a solid block of EPS, as indicated for block 43. These solid bodies or blocks **4*o*-43 may contain little or no internal cavities, for example, solid bodies 40-43 may be substantially continuous blocks of material, such as, EPS. In another aspect, one or more of bodies 40-43 (or single integral body 39) may comprise voids or cavities in an otherwise solid block of material, for instance, as indicated by internal cavities 52 in body 40, by internal cavity 54 in body 41, and by internal cavity 56 in body 42. Though not apparent in the cross-sectional view shown in FIG. 5, internal cavities 52, 54, and 56 may comprise arcuate cavities extending along a common radius within their respective blocks 40, 41, and 42 (or within single integral body 39). The cavities 52, 54, and 56, among others, may be provided to reduce the weight of stair structure 20 and/or to reduce the amount of material needed to construct stair structure 20, among other reasons. In addition, cavities 52, 54, and 56 may be provided for storage space or for a space to introduce ballast, if needed, for example, sand or stone, within stair structure 20. Though bodies 40-43 (or single integral body 39) are shown in FIG. 5 having varying size and shaped cavities for illustrative purposes, according to aspects of the invention, bodies 40-43 may typically have similarly-sized and similarly-shaped cavities 52, 54, and 56**, or have no cavities at all.

FIGS. 6A and 6B are detailed views of the cross section shown in FIG. 5 identified by detail 6 in FIG. 5. FIGS. 6A and 6B illustrate cross sections of the components of liner-retaining device 34 (or any other liner-retaining device disclosed herein) that may be used according to aspects of the invention. FIG. 6A illustrates the components of liner-retaining device 34 prior to engagement with liner 22 and FIG. 6B illustrates the components of liner-retaining device 34 after engagement with liner 22.

As shown in FIG. 6A, liner-retaining device 34 may typically include an elongated appendage or "bead" 36 and a cooperating strip or track 38 having an open channel 39 sized to receive and retain bead 36. Bead 36 may have a base 37 and the base 37 may be attached to liner 22 by conventional means for example, by thermal adhesion (for example, welding) or by the use of an adhesive. Though many conventional beads 36 and tracks 38 may be used in aspects of the invention, in the exemplary aspect shown in FIGS. 6A and 6B, liner 22 having bead 36 is typical of a liner having a bead provided by Imperial Pools, and track 38 is typical of a track provided by Vastec, though other suppliers may be used. Track 38 may typically be mounted or embedded in block 42 (or integral body 39), for example, with mechanical fasteners or an adhesive into recess 63 (see FIG. 4). As shown in FIG. 6A, with the placement of liner 22 over tread sheet 50 and riser sheet 47, bead 36 is engaged (for example, manually by the installer) with the open channel 39 of track 38 (as indicated by arrow 53) whereby bead 36 and liner 22 engage and retained by track 38. Open channel 39 of track 38 is sized to receive and retain bead 36 within open channel 39, typically by friction, as shown in FIG. 6B. FIGS. 6A and 6B illustrate one liner-retaining device that may be used; other conventional liner-retaining devices may also be used to retain liner 22 according to other aspects of the invention.

In the aspect of the invention shown in FIGS. 1 through 5, stair assembly 12, liner 22, and stair structure 20 are illustrated as having circular structures, for example, steps defining uniformly radiused sectors of circles or circular cylinders. In some aspects, these circular structures may be referred to as "wedding cake"-type structures. According to aspects of the invention, the sectors of the circles or circular cylinders may range from 30 degrees of arc to 360 degrees of arc. However, as shown in FIGS. 1-5, in one aspect, the stair assemblies 12 may comprise from about 90 degrees of arc to about 180 degrees of arc, for example, about 160 degrees of arc.

Returning to FIGS. 1 and 2, these figures are useful in illustrating the method of installing a pool stair assembly into a pool or other water-containing enclosure according to one embodiment of the invention. According to this embodiment, the method includes preparing a foundation 19 for the pool (see pool 14 in FIG. 1), for example, a sand, "gunite," or concrete foundation, and then erecting at least a partial wall 18 of the pool 14. However, typically, a complete wall, 360-degree structure 18 may be provided. When at least a partial wall 18 is provided, the method next includes positioning a stair structure or substructure 20, for example, a buoyant stair structure or substructure, having a plurality of steps 24-27 onto the foundation 19 and adjacent the at least partial wall 18 of the pool 14. Then, mounting a liner 22 over the stair structure 20 wherein each of the plurality of steps 24-27 is covered by a portion of the liner 22. Finally, in this aspect, the method includes introducing water 16 to the pool 14 wherein the weight of the water 16 upon the liner 22 retains the pool stair assembly 20 in the pool 14.

As disclosed herein, the step of positioning the stair structure 20 may be practiced by positioning a stair structure comprising a plastic foam, for example, EPF. The step of positioning the stair structure 20 may be practiced by positioning a plastic foam stair structure having a plurality of steps 24-27, each of the plurality of steps comprising a tread sheet 48-51 and a riser sheet 44-47. As also disclosed herein, the step of mounting the liner 22 over the structure 20 may be practiced by engaging the beads 36 of liner 22 with liner retaining devices 32-35 on the stair structure 20.

According to one aspect of the invention, stair assemblies may be provided requiring little or no attachment to or retention to a pool foundation or a pool wall. For example, in one aspect, the pool stair assembly may be "self-retaining," for example, requiring no hardware to retain the stair assembly in a pool. Specifically, in one aspect, little or no attachment hardware or structures or retaining hardware or structures may be required to install a stair assembly due to the retention of the stair assembly by the weight of the pool water, for example, solely or only by the weight of the pool water. It will be understood by those of skill in the art that some minor or inconsequential attachment hardware or structures or retaining hardware or structures may be provided, for example, for leveling, tolerance uptake, and the like, while substantially retaining the stair structure with the weight of pool water.

In other aspects of the invention, it is envisioned that stair assemblies 12, liners 22, and stair structures 20 are not limited to such radiused steps, but may comprise linear or curvilinear shapes, among other shapes. Some of these shapes of aspects of the invention are illustrated in FIGS. 7 and 8.

Figure 7:
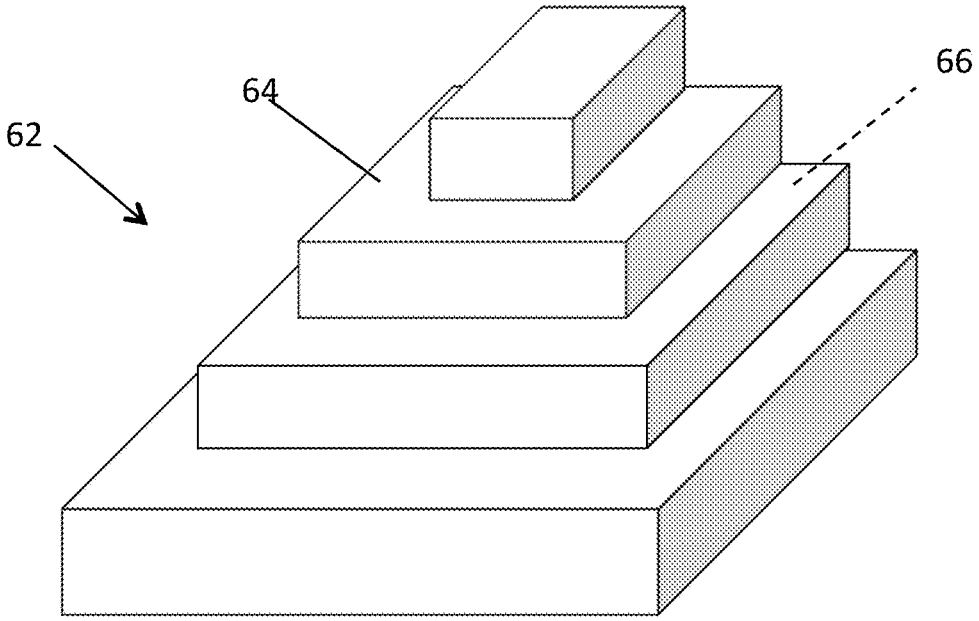
FIG. 7 is a perspective view of a pool stair assembly according to another aspect of the invention.

FIG. 7 is a perspective view of a pool stair assembly 62 according to another aspect of the invention. As shown, in contrast to stair assembly 12 shown and described with respect to FIG. 1-5, stair assembly 62 comprises 2 or more rectangular or square steps having a rectangular or square liner 64 and a corresponding rectangular or square stair structure 66. Stair structure 66 may be similar in construction to stair structure 20 disclosed above, for example, comprising a plurality of bodies or blocks (for example, plastic foam blocks) or a single integral block formed into steps. Liner 64 may be similar to liner 22 disclosed above. Similar to stair assembly 12 described above, stair assembly 62 typically may include a plurality of appropriately shaped and positioned riser sheets, tread sheets, and liner-retaining devices (not shown).

Figure 8:
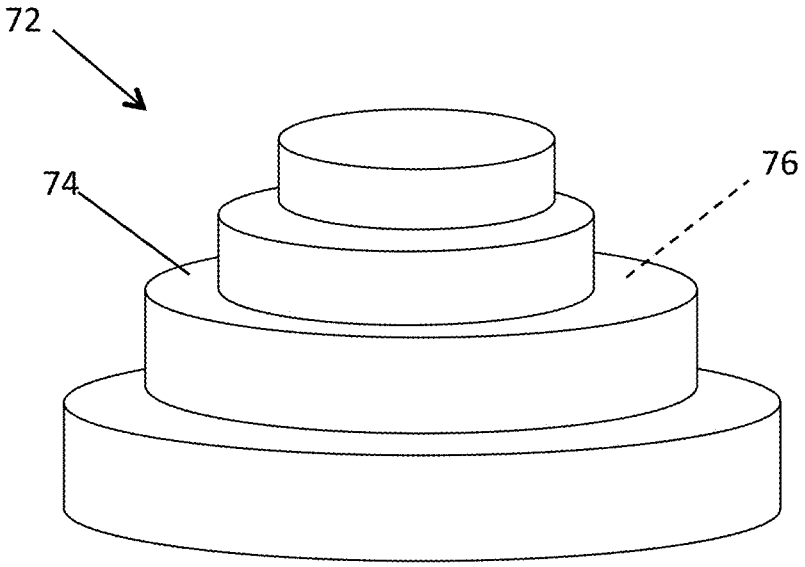
FIG. 8 is a perspective view of a pool stair assembly according to a further aspect of the invention.

FIG. 8 is a perspective view of a pool stair assembly 72 according to another aspect of the invention. As shown, in contrast to stair assembly 12 shown and described with respect to FIGS. 1-5, stair assembly 72 comprises 2 or more elliptical or oval steps having a elliptical or oval liner 74 and a corresponding elliptical or oval stair structure 76. Stair structure 76 may be similar in construction to stair structure 20 disclosed above, for example, comprising a plurality of bodies or blocks (for example, plastic foam blocks) or a single integral block formed into steps. Liner 74 may be similar to liner 22 disclosed above. Similar to stair assembly 12 described above, stair assembly 72 typically may include a plurality of appropriately shaped and positioned riser sheets, tread sheets, and liner retaining devices (not shown).

Figure 9:
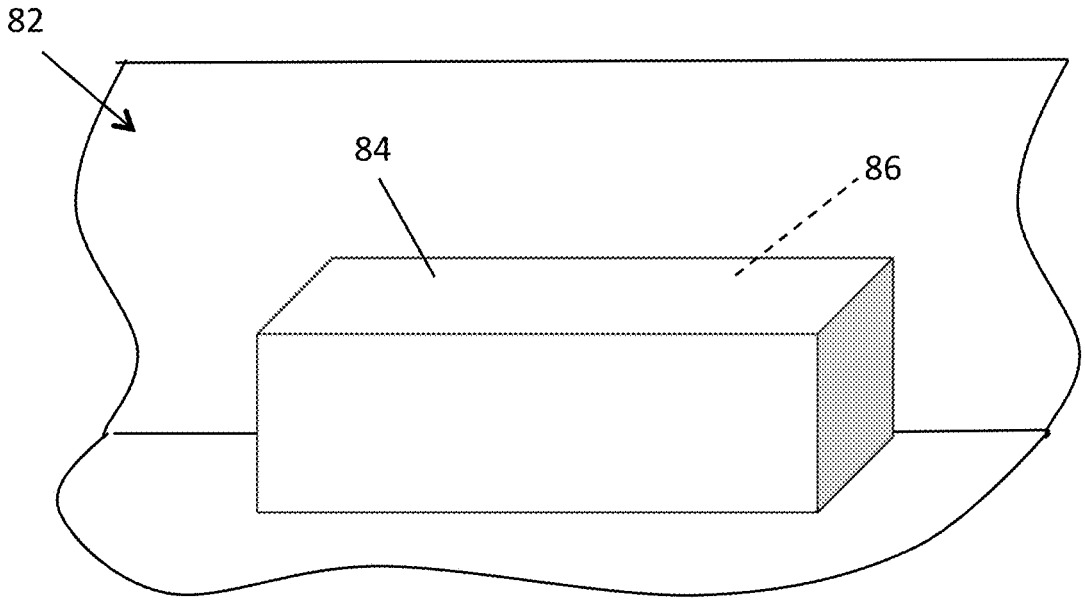
FIG. 9 is a perspective view of a pool bench assembly according to another embodiment of the invention.

FIG. 9 is a perspective view of a pool bench assembly 82 according to another embodiment of the invention. In this embodiment, pool bench assembly 82 comprises 2 or more rectangular or square benches having a rectangular or square liner 84 and a corresponding rectangular or square bench structure 86. Though not shown in FIG. 9, in one aspect, pool bench assembly 82 may be circular, arcuate, and/or oval, for example, in a manner similar to pool stair assembly 12. Bench structure 86 may be similar in construction to stair structure 20 disclosed above, for example, comprising a plurality of bodies or blocks (for example, plastic foam blocks) or a single integral block formed into a bench or benches. Liner 84 may be similar to liner 22 disclosed above. Similar to stair assembly 12 described above, bench assembly 82 typically may include one or more appropriately shaped and positioned riser sheets, tread sheets, and liner retaining devices (not shown).

Figure 10:
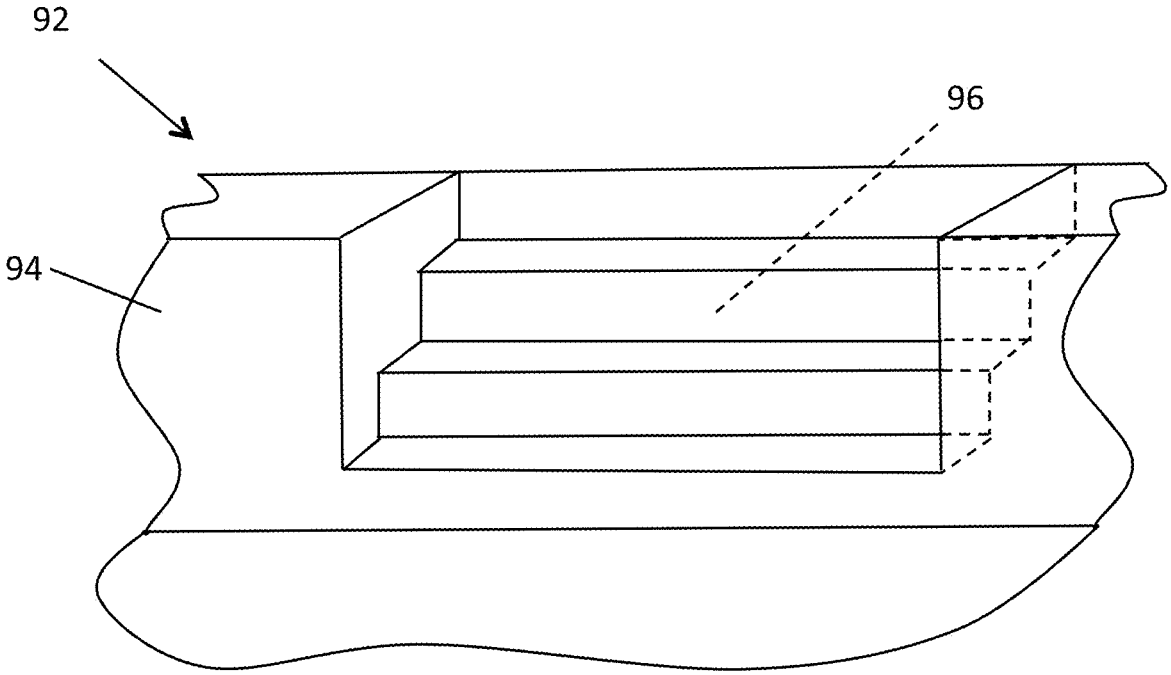
FIG. 10 is a perspective view of a pool stair assembly according to another embodiment of the invention.

FIG. 10 is a perspective view of a pool stair assembly 92 according to another embodiment of the invention. As shown, in contrast to stair assembly 12 shown and described with respect to FIG. 1-5, stair assembly 92 comprises a recessed stair assembly—in contrast to the projecting stair assembly 12 shown in FIGS. 1-5. As shown in FIG. 9, stair assembly 92 my comprise a plurality of steps that are recessed in the wall of a pool, for example, an in-ground pool, though stair assembly 92 may also be adapted to above-ground pools and partially in-ground pools. Stair assembly 92 may include 2 or more rectangular, square, round, oval, or arched steps having a corresponding rectangular, square, round, oval, or circular liner 94 and a corresponding rectangular, square, round, oval, or circular stair structure 96. Stair structure 96 may be similar in construction to stair structure 20 disclosed above, for example, comprising a plurality of bodies or blocks (for example, plastic foam blocks) or a single integral block formed into steps. Liner 94 may be similar to liner 22 disclosed above. Similar to stair assembly 12 described above, stair assembly 92 typically may include a plurality of appropriately shaped and positioned riser sheets, tread sheets, and liner-retaining devices (not shown).

Though not illustrated in FIGS. 1-10, embodiments of the present invention can be enhanced with the addition of conventional stair accessories, including handrails, skimmers, fountains, lighting, and the like.

As outlined in detail above, embodiments of the present invention, in its many aspects, provide pool stair assemblies—and related pool structures—that overcome the disadvantages of prior art pool ladders and stair assemblies. Since aspects of the present invention include stair structures positioned beneath the pool liner, damage to the pool liner due to contact by the ladder or stair assembly is substantially eliminated. In addition, since aspects of the invention can be retained beneath the pool liner by the weight of pool water, mounting or retaining hardware, structural retaining members and support members—and their weight—may be substantially eliminated when employing aspects of the invention. Moreover, contrary to prior art masonry or concrete construction, aspects of the invention provide lightweight, for example, plastic foam, stair and related structures that can more easily handled, manipulated, stored, shipped, installed, serviced, and maintained compared to existing stair structures.

A still further advantage of aspects of the invention is that since no metallic support structure, concrete bases, concrete forms, and constructions are required, aspects of the invention may be fabricated off-site, for example, in the provider's shop. Accordingly, in one aspect, a "pre-fabricated" pool stair assembly is provided. This off-site fabrication, or "pre-fabrication," allows the pool owner, pool provider, and/or pool installer to transport the one or more prefabricated stair components, for example, the stair structure and the liner, to the installation site and readily install the stair assembly with minimal or no on-site assembly, preparation, or fabrication. In one aspect of the invention, no cement or concrete structures, and their requisite curing time, may be required to install a stair assembly or like assembly in a pool or other water-containing enclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The invention claimed is:

1. A pool stair assembly comprising:

a stair structure having a plurality of rectangular steps, each of the plurality of rectangular steps comprising a plastic foam, and wherein the stair structure is adapted to be positioned against an internal surface of a wall of a pool, wherein each of the plurality of rectangular steps are directed opposite the internal surface of the wall of the pool; and a liner mounted over the stair structure, the liner attached to the pool wall, and wherein each of the plurality of rectangular steps is covered by a portion of the liner;

wherein, when the pool stair assembly is positioned against the internal surface of the pool wall and beneath a surface of water in the pool and wherein the liner substantially isolates the stair structure from the water, only the weight of the water upon the liner and the stair structure and attachment of the liner to the pool wall retains the pool stair assembly in the pool.

2. The pool stair assembly as recited in claim 1, wherein the stair structure is buoyant in water.

3. The pool stair assembly as recited in claim 1, wherein the stair structure comprising a plastic foam consists of the plastic foam.

4. The pool stair assembly as recited in claim 1, wherein the stair structure comprises a plurality of plastic foam blocks.

5. The pool stair assembly as recited in claim 1, wherein each of the plurality of plastic foam blocks defines one of the plurality of rectangular steps.

6. The pool stair assembly as recited in claim 1, wherein the plurality of rectangular steps comprises a plurality of square steps.

7. The pool stair assembly as recited in claim 1, wherein each of the plurality of rectangular steps further comprise a tread sheet and a riser sheet.

8. The pool stair assembly as recited in claim 1, wherein the pool comprises one of an above-ground pool, a partially-in-ground pool, and an in-ground pool.

9. The pool stair assembly as recited in claim 1, wherein at least some of the plurality of rectangular steps comprise a liner-retaining device adapted to engage the liner and at least partially retain the liner.

10. The pool stair assembly as recited in claim 9, wherein the liner-retaining device comprises a track embedded in the at least some of the plurality of rectangular steps.

11. The pool stair assembly as recited in claim 1, wherein the plurality of rectangular steps comprises two or more rectangular steps.

12. The pool stair assembly as recited in claim 1, wherein the pool stair assembly comprises a recessed pool stair assembly.

13. A pool stair assembly comprising:

a stair structure having a plurality of rectangular plastic foam steps, each of the plurality of plastic foam steps, each of the plurality of plastic foam steps having a plastic tread sheet and a plastic riser sheet, wherein the stair structure is adapted to be positioned against an internal surface of a wall of a pool wherein each of the plurality of rectangular plastic foam steps is directed opposite the internal surface of the wall of the pool; and a liner mounted over the stair structure and attached to the pool wall, wherein each plastic tread sheet and each plastic riser sheet of the plurality of rectangular plastic foam steps are covered by a portion of the liner;

wherein, when the pool stair assembly is positioned against the internal surface of the pool wall and beneath a surface of water in the pool and wherein the liner substantially isolates the stair structure from the water, only the weight of the water upon the liner and the stair structure and attachment of the liner to the pool wall retains the pool stair assembly in the pool.

14. The pool stair assembly as recited in claim 13, wherein each of the plurality of rectangular plastic foam steps comprises a plastic foam block.

15. The pool stair assembly as recited in claim 14, wherein the plastic foam block comprises an expanded polystyrene foam block.

16. The pool stair assembly as recited in claim 13, wherein the plurality of rectangular plastic foam steps comprises a plurality of square plastic foam steps.

17. The pool stair assembly as recited in claim 13, wherein the pool comprises one of an above-ground pool, a partially-in-ground pool, and an in-ground pool.

18. The pool stair assembly as recited in claim 13, wherein the plurality of rectangular plastic foam steps comprises two or more rectangular plastic foam steps.

19. The pool stair assembly as recited in claim 13, wherein the pool stair assembly comprises a recessed pool stair assembly.

20. The pool stair assembly as recited in claim 13, wherein at least some of the plurality of rectangular plastic foam steps comprise a liner-retaining device adapted to engage the liner and at least partially retain the liner.

* * * * *